US008511726B2

(12) United States Patent
Lennhoff et al.

(10) Patent No.: US 8,511,726 B2
(45) Date of Patent: Aug. 20, 2013

(54) OUTSIDE DOOR GRIP, IN PARTICULAR FOR VEHICLES

(75) Inventors: Ralf Lennhoff, Hagen (DE); Sascha Pfeiffer, Wuppertal (DE)

(73) Assignee: Huf Hülsbeck & Fürst GmbH & Co. KG., Velbert (DE)

( * ) Notice: Subject to any disclaimer, the term of this patent is extended or adjusted under 35 U.S.C. 154(b) by 844 days.

(21) Appl. No.: 12/456,155

(22) Filed: Jun. 12, 2009

(65) Prior Publication Data

US 2009/0309374 A1 Dec. 17, 2009

(30) Foreign Application Priority Data

Jun. 13, 2008 (DE) ..... 10 2008 028 391

(51) Int. Cl.
*E05B 3/00* (2006.01)
*E05B 65/10* (2006.01)

(52) U.S. Cl.
USPC ..... 292/336.3; 292/80; 292/DIG. 65

(58) Field of Classification Search
USPC ..... 292/80, 336.3, DIG. 65
See application file for complete search history.

(56) References Cited

U.S. PATENT DOCUMENTS

| | | | | |
|---|---|---|---|---|
| 3,719,248 | A * | 3/1973 | Breitschwerdt et al. | 180/271 |
| 4,482,179 | A * | 11/1984 | Johnson | 292/336.3 |
| 5,769,471 | A * | 6/1998 | Suzuki et al. | 292/336.3 |
| 6,042,159 | A * | 3/2000 | Spitzley et al. | 292/216 |
| 6,382,688 | B1 * | 5/2002 | Agostini | 292/336.3 |
| 6,471,262 | B1 * | 10/2002 | Schwab | 292/336.3 |
| 6,565,134 | B1 * | 5/2003 | Stuart et al. | 292/336.3 |
| 6,575,508 | B2 * | 6/2003 | Stuart et al. | 292/336.3 |
| 6,709,033 | B2 * | 3/2004 | Jooss et al. | 292/336.3 |
| 7,029,042 | B2 * | 4/2006 | Belchine, III | 292/336.3 |
| 7,070,216 | B2 * | 7/2006 | von zur Muehlen | 292/336.3 |
| 7,303,217 | B2 * | 12/2007 | Savant | 292/336.3 |
| 7,597,368 | B2 * | 10/2009 | Savant et al. | 292/336.3 |
| 7,635,151 | B2 * | 12/2009 | Rodawold et al. | 292/336.3 |
| 7,677,614 | B2 * | 3/2010 | Monig | 292/336.3 |
| 8,038,185 | B2 * | 10/2011 | Wood | 292/336.3 |
| 2009/0026774 | A1 * | 1/2009 | Watanabe et al. | 292/336.3 |

FOREIGN PATENT DOCUMENTS

| | | |
|---|---|---|
| DE | 2413685 | 4/1975 |
| DE | 19858414 | 6/2000 |
| DE | 19929022 | 6/2001 |
| DE | 10114965 | 10/2002 |
| DE | 10114583 | 12/2002 |
| EP | 1050640 | 11/2006 |

* cited by examiner

*Primary Examiner* — Carlos Lugo
(74) *Attorney, Agent, or Firm* — Horst M. Kasper

(57) ABSTRACT

The invention relates to an outside door grip, in particular for vehicles. The outside door grip exhibits a manually actuated handle, which engages a lock disposed in the door upon actuation. In addition, a pivotable blocking member serving as a mass blockage is furnished, which blocking member is disposed generally in its ineffective disengagement position, wherein the handle remains actuatable, which blocking member moves into an effective blocking position based on the inertia of its mass in case of a crash and thereby blocks the handle. Furthermore a damping device is furnished which takes care that the blocking member remains at least so long in its blocking position in case of a crash, until oscillations caused by the crash and acting on the outside door grip and/or the handle, have decayed so far that an effective actuation of the handle by the oscillations is not any longer possible.

15 Claims, 11 Drawing Sheets

OUTSIDE DOOR GRIP, IN PARTICULAR FOR VEHICLES

BACKGROUND OF THE INVENTION

1. Field of the Invention

The invention relates to an outside door grip with a manually actuatable handle, in particular for vehicles, wherein the handle operates upon actuation on a lock disposed in the door with a pivotable blocking member serving as a mass blockage, wherein the blocking member in fact normally is disposed in its ineffective disengagement position and therewith renders the handle actuatable, which however based on the inertia of its mass passes into an effective blocking position in case of a crash and therewith the blocking member blocks the handle.

2. Brief Description of the Background of the Invention Including Prior Art

Such devices are used in particular in connection with motor vehicles. In case of a crash, in particular in case of an accident with a strong side impact, it has to be prevented that through the forces being released during the crash the handles of the vehicle doors are swiveled toward the outside and the doors thus open unintentionally. For example persons or objects present in the inner space can thereby be thrown out of the vehicle. In order to avoid this unintentional opening, according to the state-of-the-art, pivoted blocking members are proposed, which are deflected by the inertia of their mass and thereby avoid an effective actuation of the handle and thereby an opening of the vehicle doors.

The European patent document EP 1 050 640 A 2 describes also a door grip for vehicles with a pendulum like blocking member. This is constructed such that it becomes deflected in case of a crash before the handle can activate the door in question. If then the handle is also deflected by the crash, thereupon the blocking member forms a connection between the support and the handle such that the door cannot be inadvertently opened.

The German printed patent document DE 199 29 022 A 1 also describes an outside door grip for vehicles with a blocking member, which based on the inertia of its mass is deflected into a support position in case of a crash and thereby blocks the grip and prevents an inadvertent opening of the door.

The two above recited and all further known up to now solutions have the common feature that the blocking member as well as the device components cooperating with the blocking member prevent an opening of the door only in the first moment of the crash. All these solutions do not consider that all construction components, that is also the handle and the blocking member are placed in an oscillation through the crash. Thus it is then possible that in fact at the first moment of the crash, the motion of the handle is blocked by the blocking member, then however based on the different frequency of the oscillations caused by the crash in the individual device components at some time the blocking member is brought out of its blocking position, while the handle is deflected such that the lock is actuated and then nevertheless the door opens unintentionally. Furthermore it has to be possible however to pass from the outside into the inner space by opening of the vehicle doors after the occurrence of a crash in order to release for example persons disposed in the interior space from the vehicle subjected to an accident.

SUMMARY OF THE INVENTION

1. Purposes of the Invention

It is therefore an object of the present invention to furnish an outside door grip, in particular for vehicles, with a manually actuating handle, which handle upon actuation operates a lock disposed in the door and with a swivelable blocking member serving as a mass blockage, which blocking member normally is disposed in its ineffective disengagement position and which thereby renders the handle actuable, which blocking member however based on the inertia of its mass passes in case of a crash into an effective blocking position and thereby blocks the handle. The outside door handle avoids an unintentional opening of the door despite the oscillations of the blocking member and of the handle caused by the crash, which however at the same time allows an opening of the vehicle door from the outside after the occurrence of an accident.

2. Brief Description of the Invention

This object is obtained by furnishing means which takes care that in case of a crash the blocking member remains at least so long in its blocking position until the oscillations caused by the crash and acting on the outside door grip and/or the handle have decayed so far that an actuation of the handle cannot any longer be performed based on the decayed oscillations.

The outside door handle exhibits means which take care that in the case of a crash the blocking member is held in its blocking position at least so long until the vibrations caused by the crash, which act on the outside door grip, the handle and/or further device components, have decayed so far that and activation of the handle and therewith an unintentional opening of the door cannot any longer be performed based on the decayed vibrations.

According to a preferred embodiment this is realized by way of a snap-in locking device, which locks the blocking member in its blocking position. It is particularly advantageous if this is a releasable locking, which in principle also could occur several times such that the outside door grip does not have to be exchanged after an accident or, respectively, a case of a crash.

Another possibility to maintain the blocking member in its blocking position results by employing a magnet or, respectively, other device components made out of a magnetic or magnetizable material. The blocking member can also be held in its blocking position based on the there prevailing magnetic forces. Here it is also not necessary that the blocking member itself consists completely out of magnetic or, respectively, magnetizable material. It would also be conceivable that the blocking member would for example only be coated with the magnetic or, respectively, magnetized material or that a magnetic element would be disposed at the blocking member or in its vicinity. If for example one employs now an electromagnet in order to hold the blocking member in its blocking position, then one can turn off the electromagnet after the ending of a predetermined time, thereby magnetic forces release the blocking member and the blocking member can swivel back into its disengagement position. In this case the door can again be opened over the handle. Of course, the blocking member itself does not have to consist out of magnetic or magnetizable material, but it is also possible to furnish other device components, which hold the blocking member with magnetic forces in the blocking position. A permanent magnet can also be furnished instead of the electromagnet, wherein the electromagnet again releases the blocking member for example by way of a larger distance from the blocking member.

A third preferred embodiment results by employing a damping device. The damping device here serves as a means which prevents that the blocking member too early again moves into its disengagement position based on the oscillations caused by the crash, that the oscillations of the handle enable an unintentional opening of the door. The damping device is preferably disposed at the bearing axis of the blocking member. The deflection of the blocking member from the disengagement position into the blocking position is not damped by the damping device, but is admitted without restriction. If the blocking member now tries however to pass back from its blocking position into the disengagement position, for example by way of the oscillations acting onto the blocking member, then the damping device damps this motion and thus delays the point in time, at which the blocking member is in fact brought out of its blocking position. Based on the time delay caused by way of the damping device, the oscillations caused by the crash have decayed so far, that an effective actuation of the handle through these decayed oscillations is not any longer possible, even if the blocking member is disposed in the disengagement position and therefore the door cannot open any longer unintentionally.

Further examples, embodiments and details are shown in the following description.

BRIEF DESCRIPTION OF THE DRAWING

There is shown in.

DESCRIPTION OF INVENTION AND PREFERRED EMBODIMENT

Figure 1:
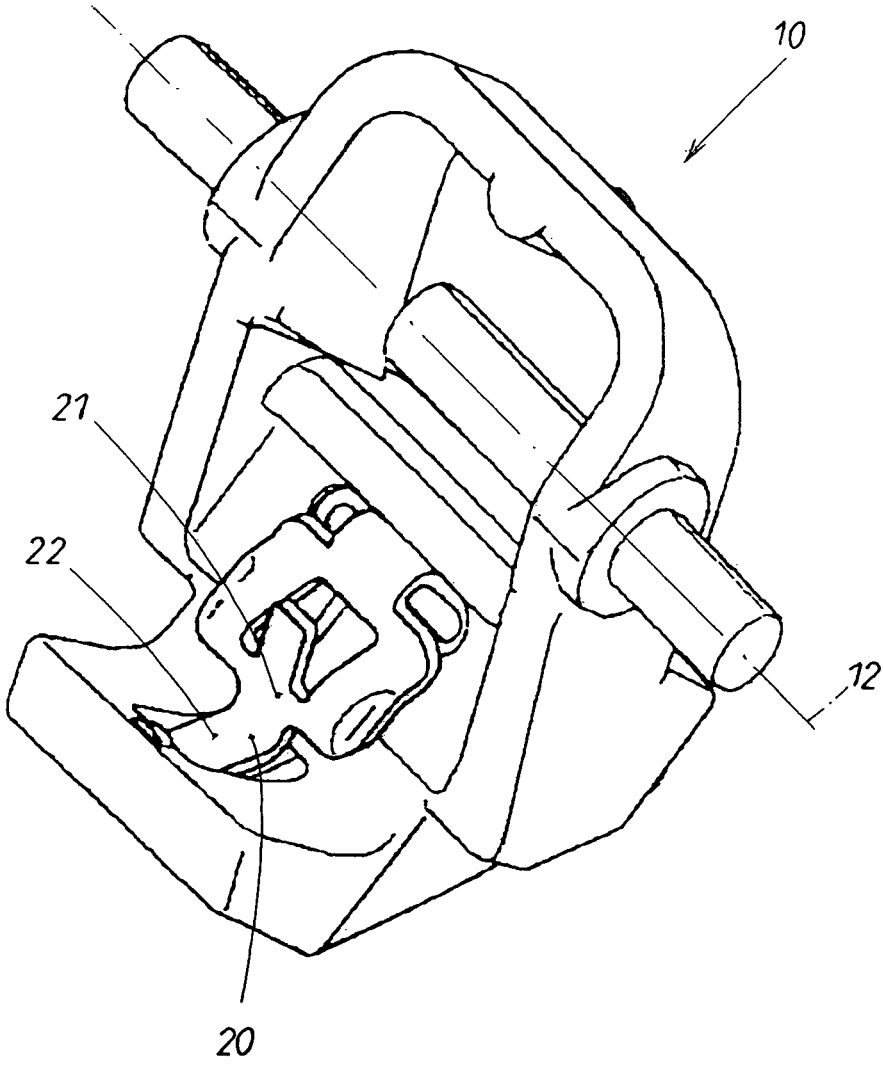
FIG. 1 a perspective view of a blocking member according to the invention with the locking element in a first embodiment, FIG. 2 the blocking member of FIG. 1 according to the present invention in its blocking position, FIG. 3 a sectional view of the blocking member according to FIG. 2 and according to the present invention, FIG. 4 a perspective view of the assembled blocking member in blocking position, FIG. 5 a sectional view of the incorporated blocking member in blocking position, FIG. 6 a sectional view of the blocking member and a part of the support in disengagement position, FIG. 7 the elements according to FIG. 6 in blocking position, FIG. 8 the elements according to FIG. 6 and FIG. 7 and the release member still in blocking position, FIG. 9 the elements according to FIG. 8 in release position, FIG. 10 an interaction between the handle and the blocking member, FIG. 11 the non-blocking position of the blocking member after an accident.

FIG. 1 shows the blocking member 10, wherein the detent element 21, which is formed as a detent spring, furnishes means 20. The locking means 22 is arranged at the detent spring 21. The blocking member 10 can be supported at the outside door grip along the longitudinal axis 12 of the blocking member 10. Here the blocking member 10 can be applied to the outside door grip itself, at the grip support 40, at the rocker 51, or also at the handle.

Figure 2:
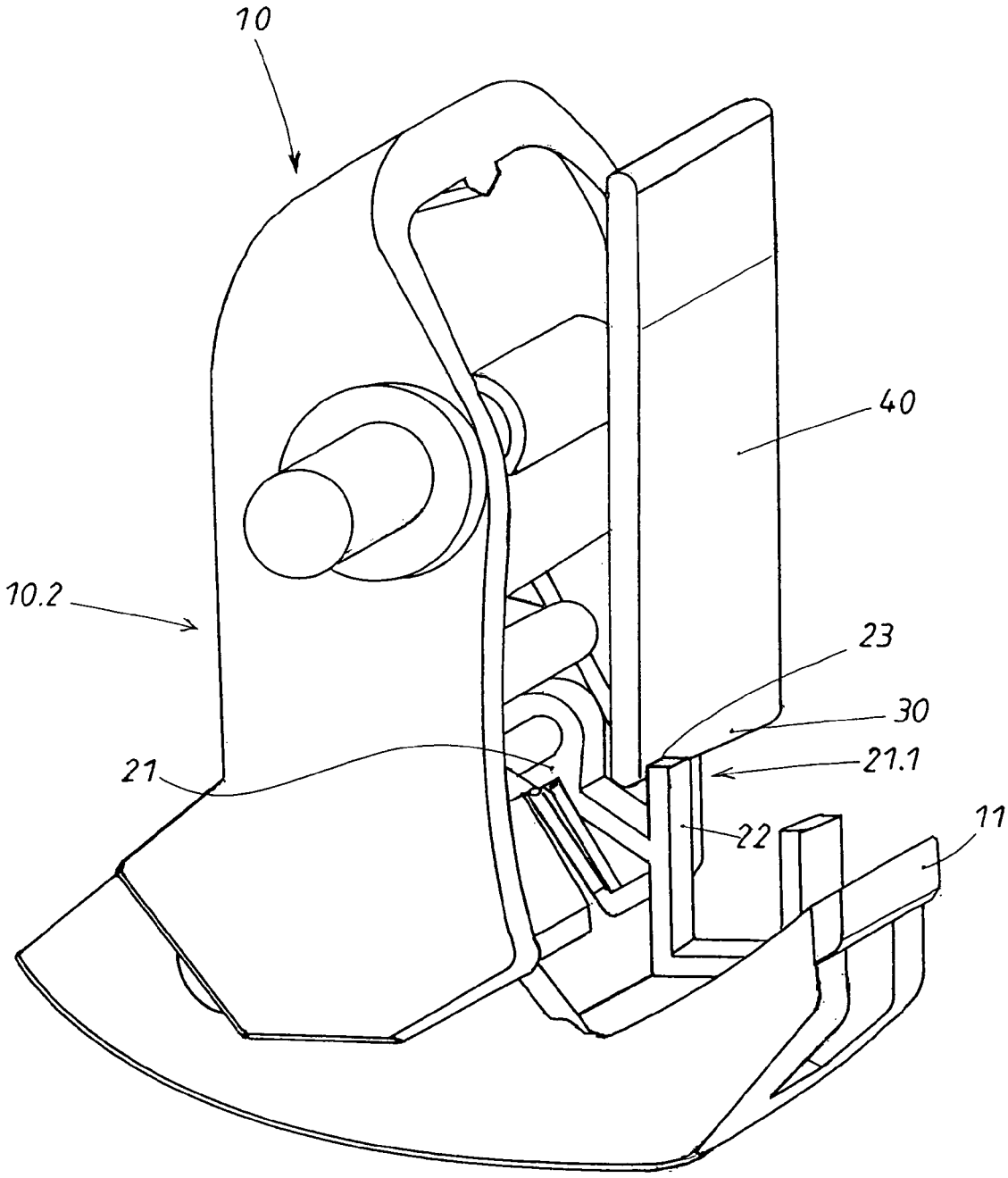
Figure 3:
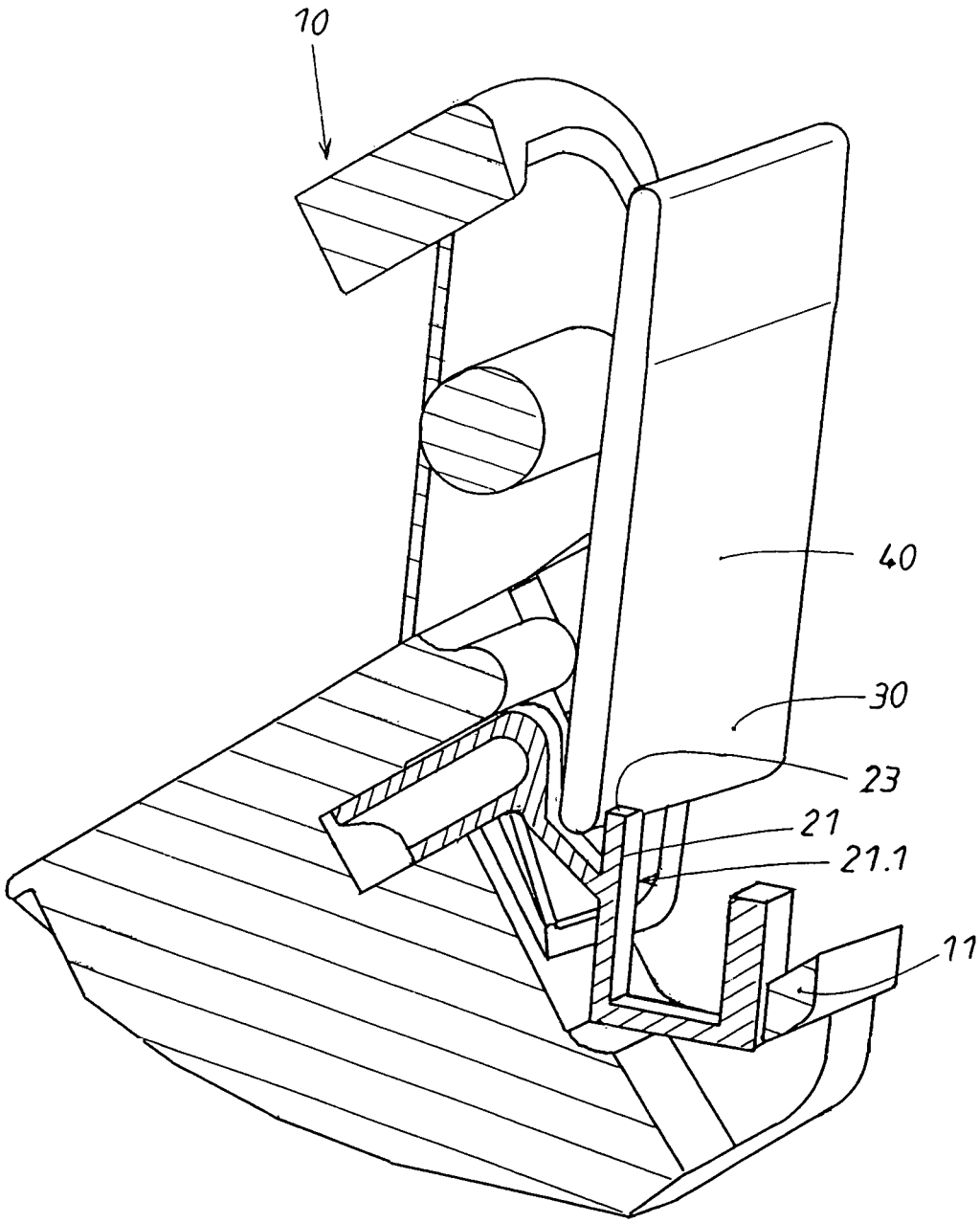

The blocking position 10.2 of the blocking member 10 can be recognized from FIG. 2 and FIG. 3 in more detail. The detent spring 21 exhibits again the locking means 22, wherein the locking means 22 together with the counter locking means 30 the snap-in locking device 23. The counter locking means 30 is furnished as a part of the support 40. It is of course also possible to place the counter locking means 30 at a different device component. The locking position 21.1 of the detent spring 21 can also be recognized. In addition, one can already recognize the opposing member 11, which is considered in more detail below.

Figure 4:
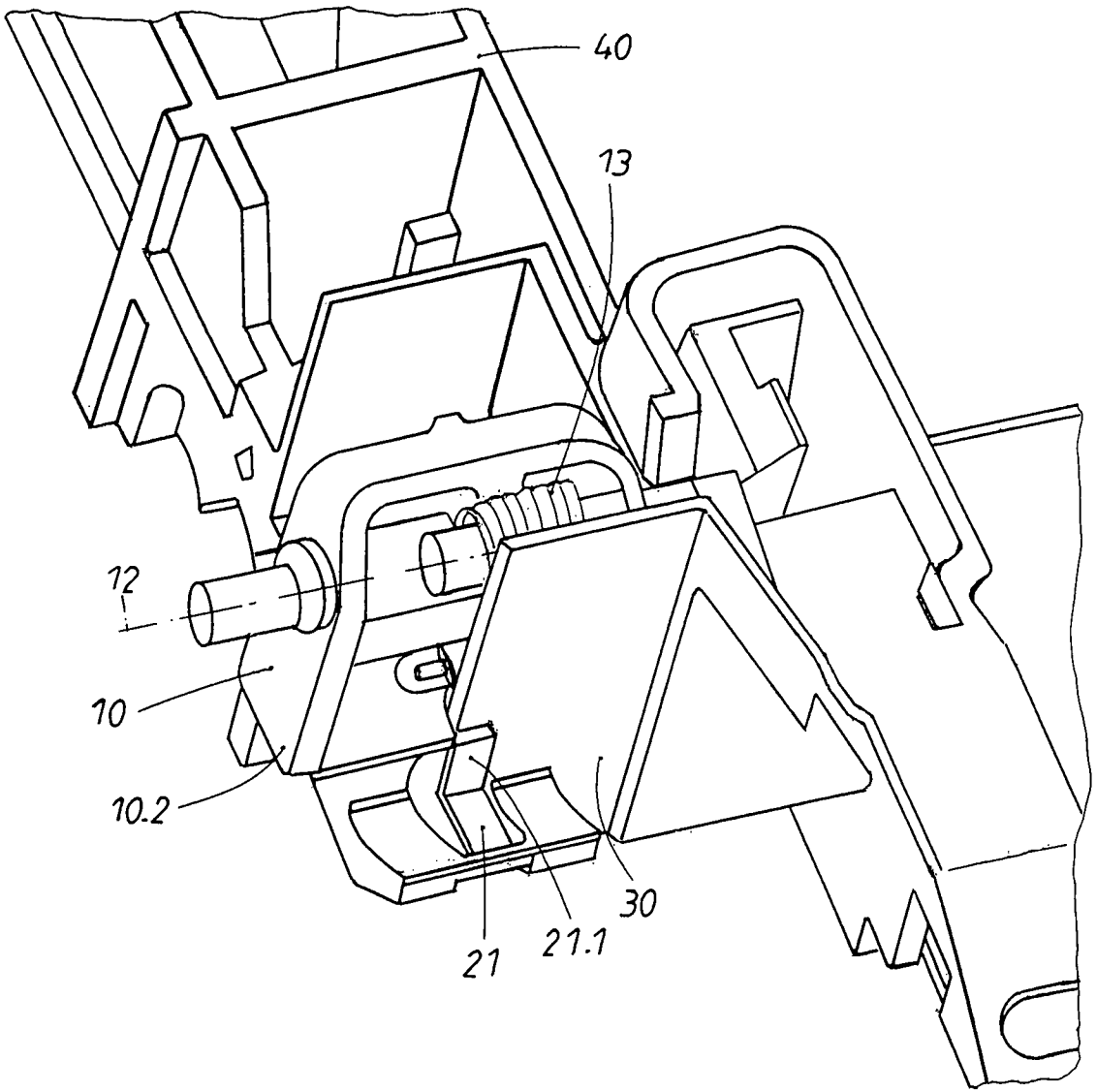

A section of the outside door grip with support 40 and blocking member 10 are shown in FIG. 4. The blocking member 10 is formed as in FIG. 1 to FIG. 3 and means 20 is furnished as a detent spring 21. This detent spring 21 is also here in the locking position 21.1, whereby the blocking member 10 is disposed in its blocking position 10.2.

The blocking member 10 is supported at the support 40 of the outside door grip with its bearing axis 12. The support 40 also exhibits the counter locking means 30 for the locking means 22 of the detent spring 21.

In order to avoid an undesirable moving of the blocking member 10 from its disengagement position 10.1 into its blocking position 10.2 during the standard operation of the vehicle and in order to furthermore bring the blocking member 10 from its blocking position 10.2 into its disengagement position 10.1 after the detent spring 21 was transferred from its locking position 21.1 to its release position 21.2, there is furnished the blocking spring 13 which is disposed also along the bearing axis 12 of the blocking member 10. The blocking spring 13 is formed here as a leg spring and, as mentioned, takes care that the blocking member 10 in fact only in case of a crash is brought into its blocking position 10.2 and wherein the blocking member 10 is on the other hand after the release of the snap-in locking device 23 also again is transferred into its disengagement position 10.1, such that the door can be opened also by an actuation of the handle. Of course the blocking spring 13 can also be formed of a different configuration.

Figure 5:
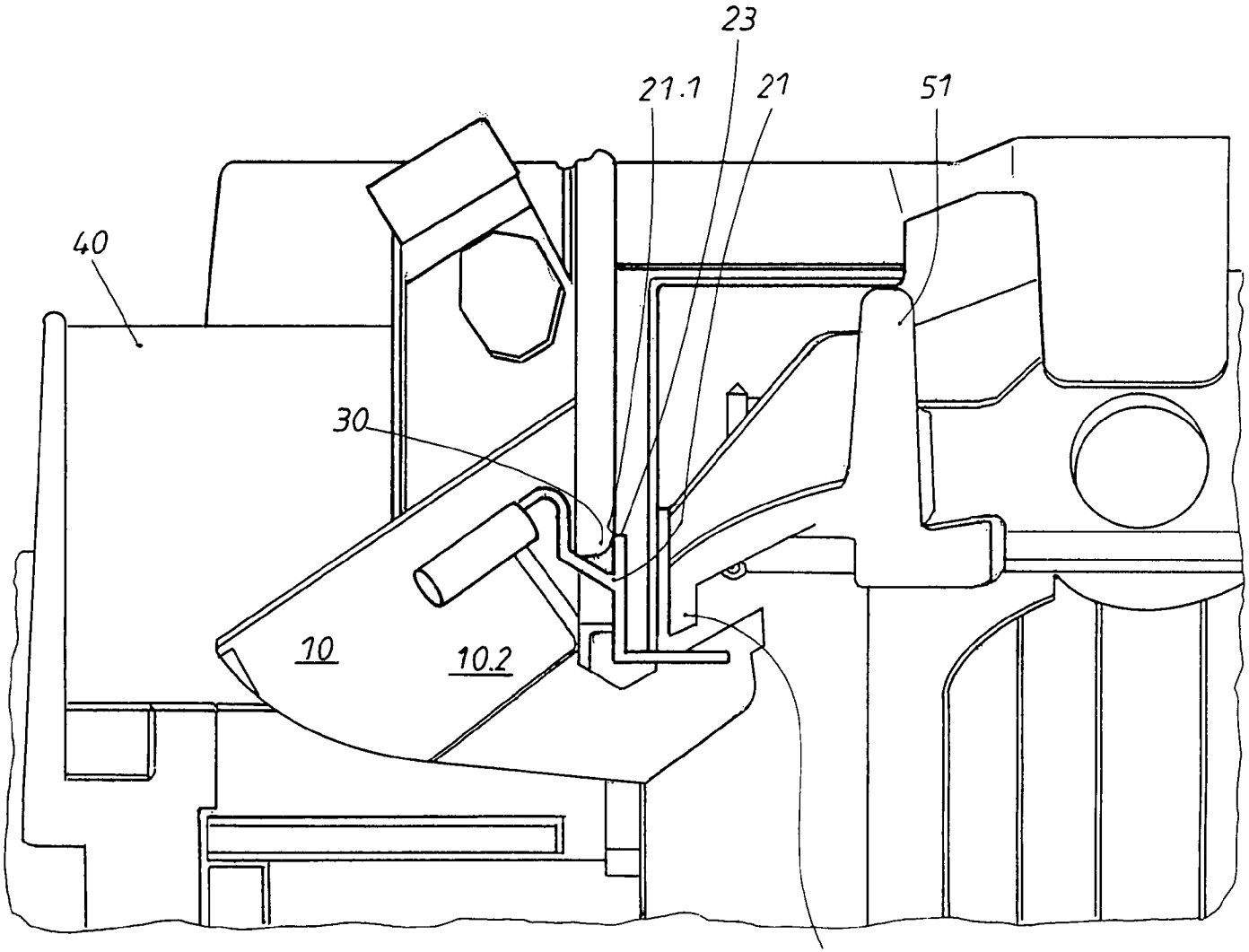

FIG. 5 shows the device components of FIG. 4 in a sectional view. The blocking member 10 is disposed in its blocking position 10.2, since the detent element 21 is positioned in its locking position 21.1. In addition, a still further element is presented, which is here the so-called rocker 51. This rocker 51 is an element which moves together with the actuation of the handle and which serves for the stability of the outside door grip. A release member 50 is disposed at the rocker 51, which release member 50 brings out the detent spring 21 from its locking position 21.1 upon actuation of the handle and thus also upon actuation of the rocker 51. This will be presented in more detail in the following.

The vehicle door can be opened from the outside over the handle of the outside door grip after a crash occurred based on the furnishing of the release member 50, even if at this point in time the detent spring 21 is still disposed in its locking position 21.1 and the blocking member 10 is still disposed in its blocking position 10.2. Since an actuation of the handle also actuates the rocker 51, the release member 50 comes into engagement position with the detent spring 21 and the release member 50 brings the detent spring 21 thus into the release position 21.2. If the handle is now, depending on the concrete embodiment, either further actuated or a second time actuated, then the door can be completely regularly opened from the outside such that the inner spaces accessible, in order to be able to liberate for example injured persons or children out of the vehicle. Of course, it is also possible to furnish the release member 50 immediately at the handle.

The FIGS. 6 to 9 now show the various courses of motion and positions through which the invention device and in particular the blocking member 10 and the detent spring 21 can pass through.

Figure 6:
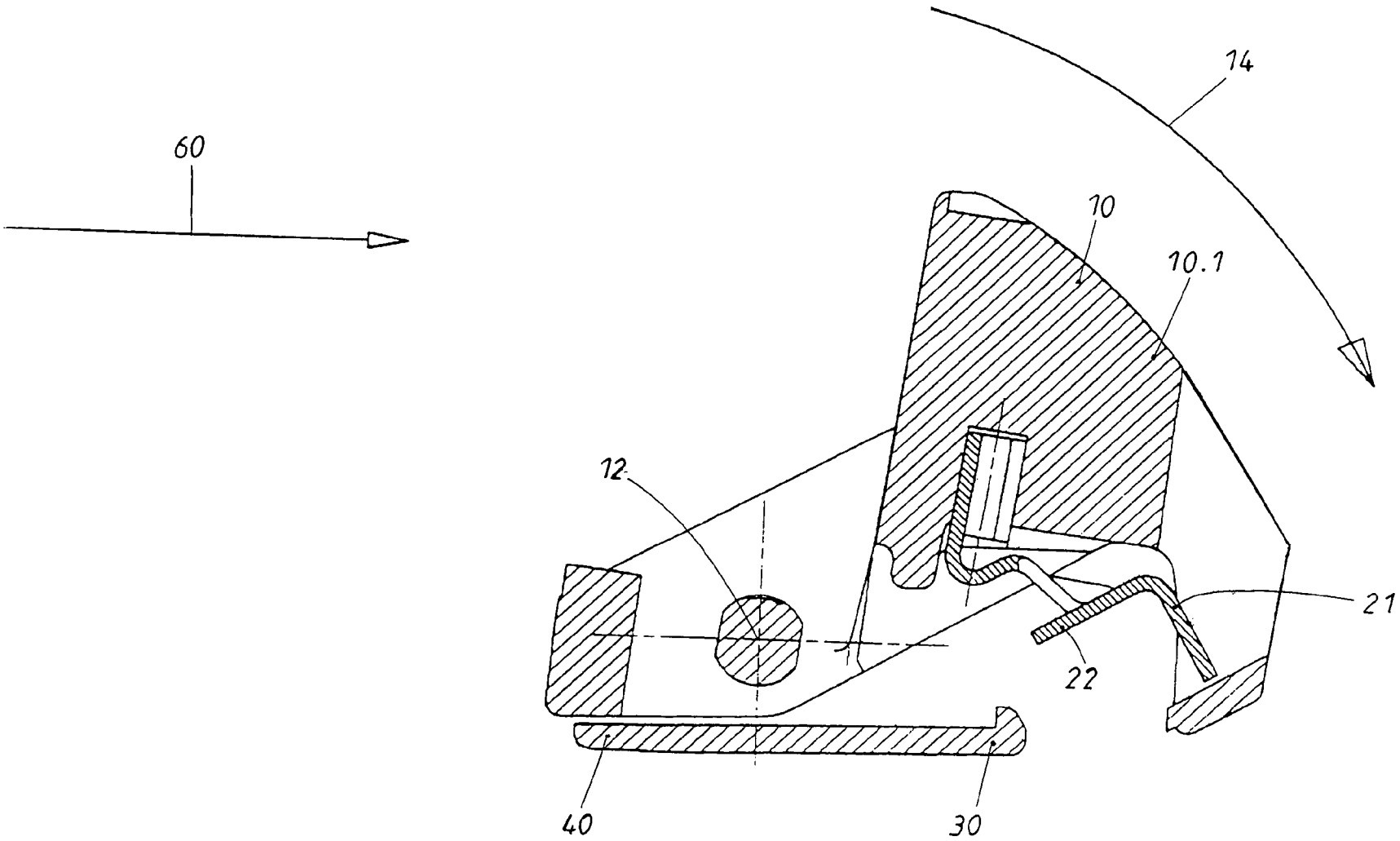

The so-called standard operation is illustrated in FIG. 6. The blocking member 10 is in the disengagement position 10.1. The detent spring 21 is located in the release position 21.2. A snap-in locking device 23 does not exist at this point in time. If now a crash occurs out of the direction 60, then the blocking member 10 moves in its direction of motion 14 around the bearing axis 12. This motion is caused by the inertia of the mass of the blocking member 10.

Figure 7:
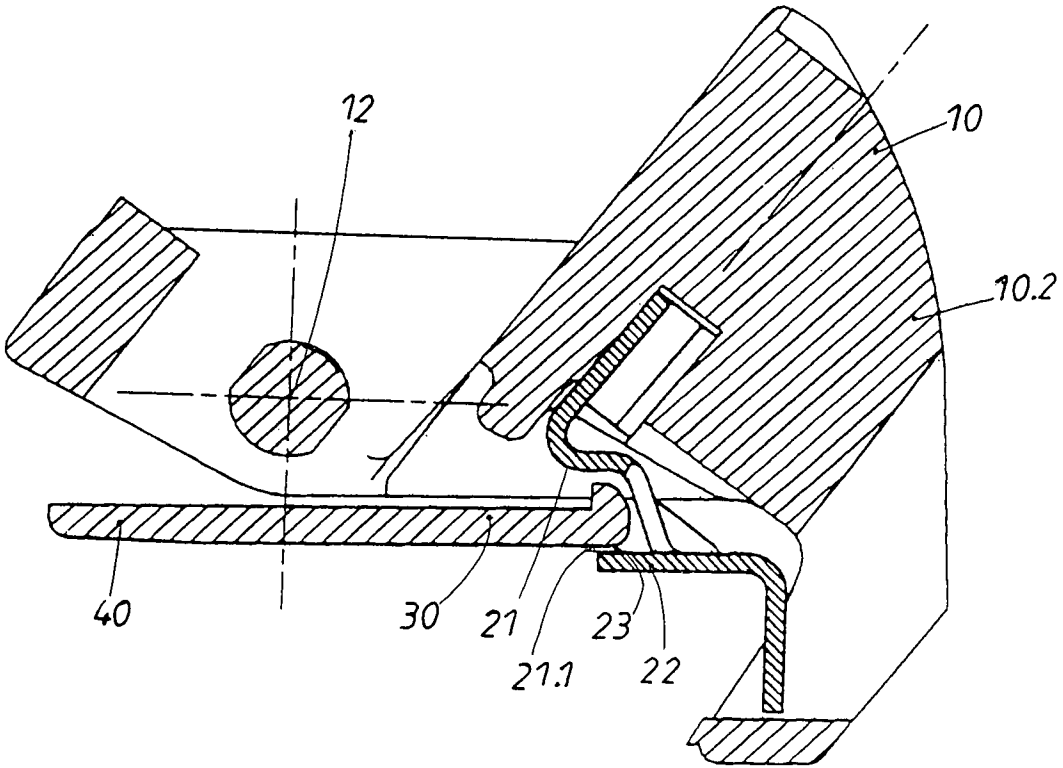

The situation shown in FIG. 7 is present immediately after the crash. The blocking member 10 is supported in its blocking position 10.2 and in fact by way of the snap-in locking device 23. This snap-in locking device 23 comes about, since the detent spring 21 is disposed in its locking position 21.1. The locking means 22 locks with the counter locking means 30 in this position. The counter locking means 30 is formed here by the support 40. An effective actuation of the handle is not possible with the presented positions. An unintentional opening of the door is thus prevented and the persons or objects present in the vehicle cannot be thrown out of the vehicle.

Figure 8:
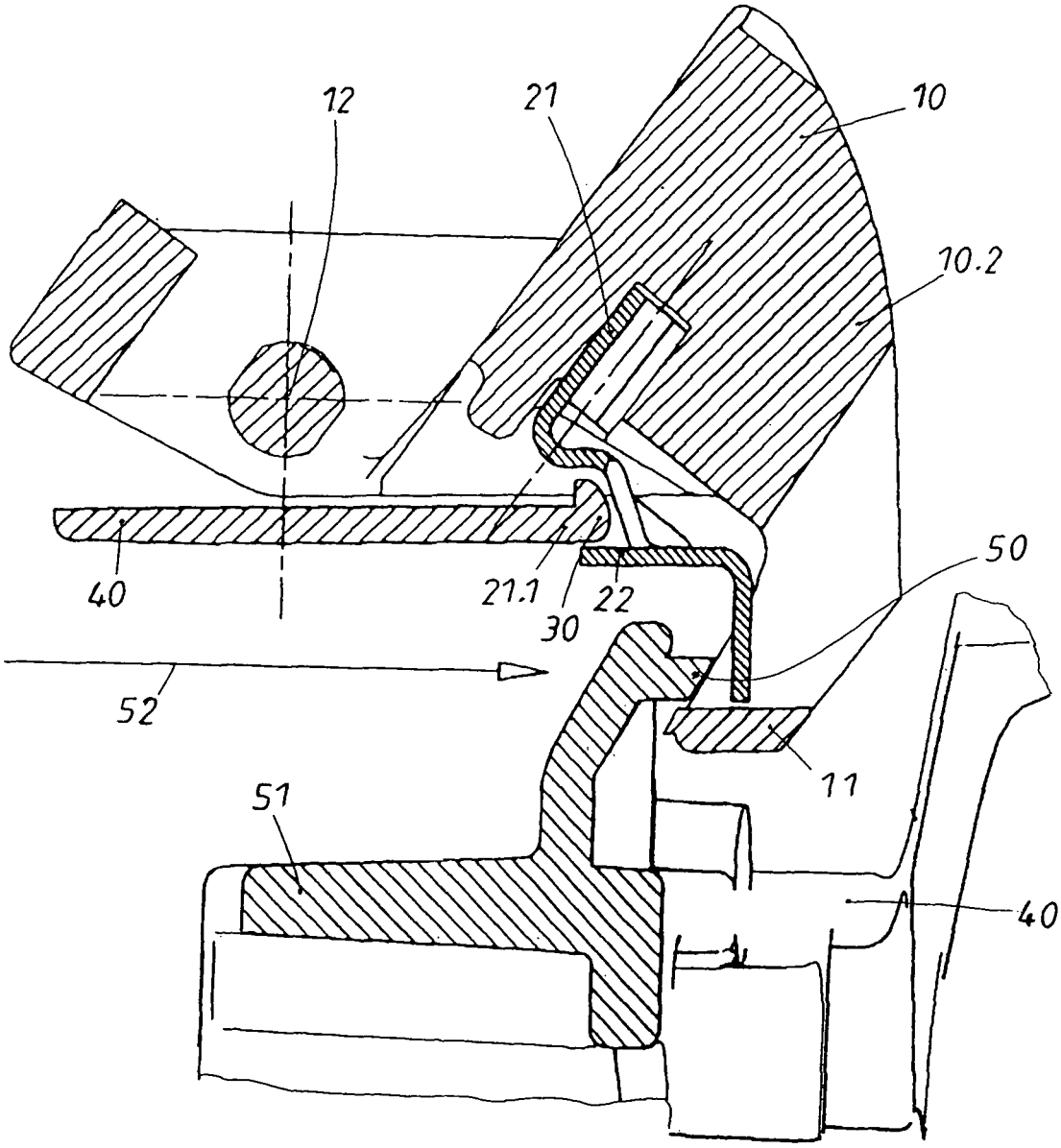
Figure 9:
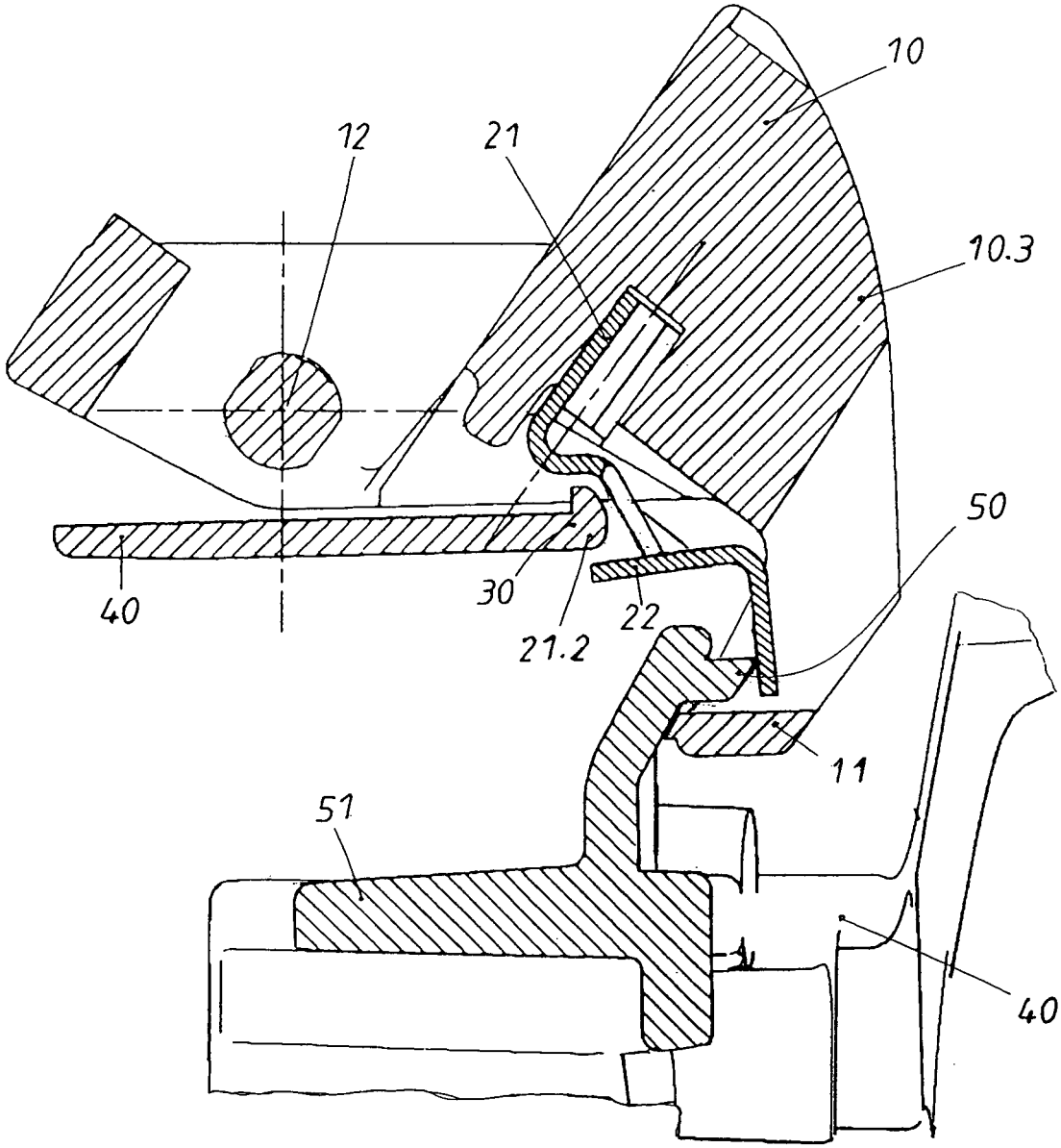
Figure 10:
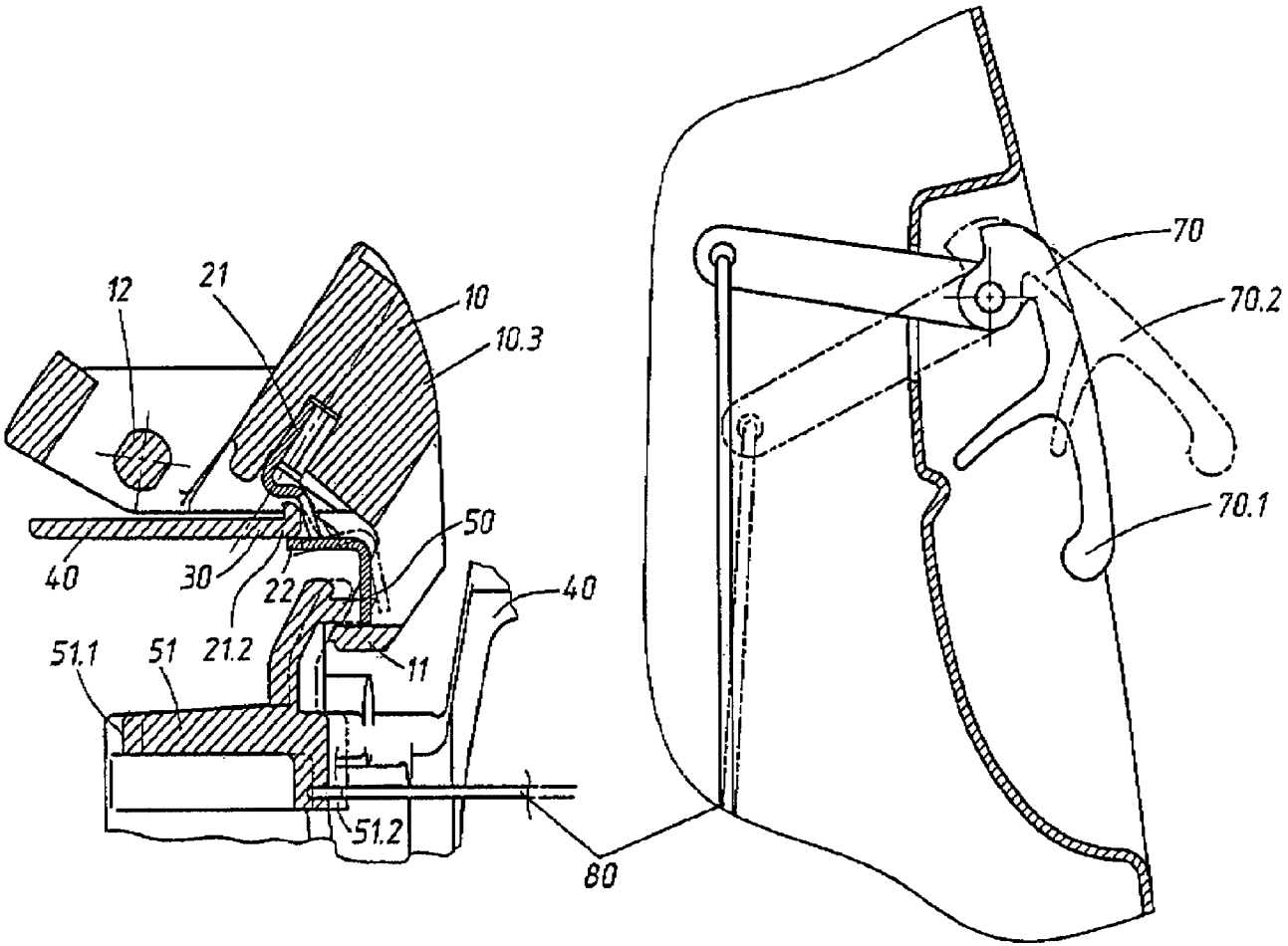
Figure 11:
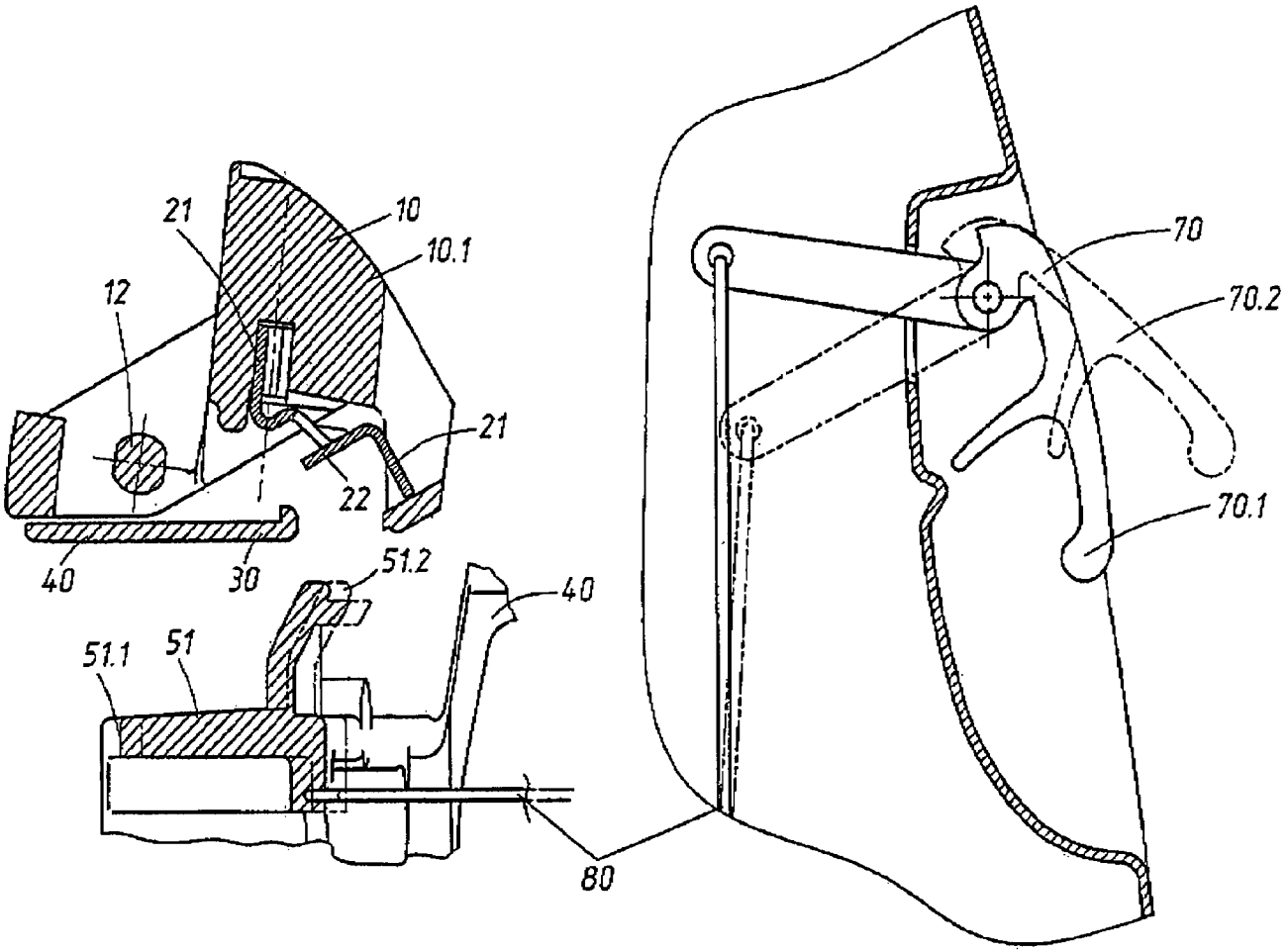

The release member 50 is drawn in addition in FIG. 8 and FIG. 9. This release member 50 moves in the direction of the release motion 52. According to FIG. 8 the blocking member 10 is still disposed in its blocking position 10.2 and the detent spring 21 is still disposed in its locking position 21.1. Here the release member 50 is disposed at the rocker 51. As shown in FIG. 9, the release member 50 has moved further along the release direction 52 and therewith moved the detent element 21 from its locking position 21.1 into its release position 21.2. However the release member 50 is in operating connection with the opposing member 11. Thus an immediate back pivoting of the blocking member 10 into the disengagement position 10.1 is avoided.

It is now also possible with the recited device that the release member 50 already releases the detent element 21 from its locking position 21.1. The blocking member 10 however still not again can be brought back into its disengagement position 10.1 by cooperating of a device component, in particular the release member 50, with an opposing member 11. Until this device component is brought again into disengagement with the opposing member 11 and the blocking member 10 can be pivoted from its release position 10.3 into its disengagement position 10.1, the oscillations caused by the crash have decayed too far that an effective actuation of the handle through the decayed oscillations could be performed and therefore also an unintentional opening of the door does not occur. In this case the door can however be opened from the outside after the crash through a completely regular activation of the handle from the outside in order to reach the interior space.

SUMMARY OF FEATURES OF THE INVENTION

According to a preferred embodiment the snap-in locking device 23 can be furnished as means 20, wherein the snap-in locking device 23 locks 21.1 the blocking member 10 in its blocking position 10.2, and in particular locks disengageably. A detent element 21 can be furnished at the blocking member 10, wherein the detent element 21 exhibits a locking means 22, wherein this locking means 22 can be brought in work connection with the counter locking means 30 in order to generate the snap-in locking device 23. The detent element can be formed as the detent spring 21. The counter locking means 30 can be formed at the support 40. The detent element 21 can be released out of the locking position 21.1 by a release member 50 and can be this way transferred into its release position 21.2. The release member 50 can release 52 the detent element 21 out of the locking position 21.1 and the detent element 21 can be transferred into its release position 21.2. A device component, preferably the release member 50, can be brought into a working connection with an opposing member 11 at the blocking member 10 during release 52 of the locking position 21.1, and that thereby the blocking member 10 is held for some time in a release position 10.3 even though detent element 21 is already disposed in its release position 21.2. The release member 50 releases the locking position based on manual actuation of the handle 52. The release member 50 can be disposed immediately at the handle. The release member 50 can be disposed at an element coupled to the handle and in particular at the rocker 51, wherein the rocker 51 moves 52 with the handle upon actuation of the handle.

A magnet or, respectively, a device component out of magnetic or magnetizable material can be furnished through which material the blocking member 10 is held in its blocking position 10.2. The magnet, which holds the blocking member 10 in its blocking position 10.2 can be an electromagnet. The magnetic forces which hold the blocking member 10 in its blocking position 10.2 can be lifted after ending of a predetermined time, in order to transfer the blocking member 10 again into its disengagement position 10.1. A damping device can be furnished as means 20, wherein the damping device preferably disposed at the bearing axis 12 of the blocking member 10. The damping device permits in fact undamped deflection 14 of the blocking member 10 from its disengagement position 10.1 to its blocking position 10.2, while the damping device damps the transfer of the blocking member 10 from its blocking position 10.2 into its disengagement position 10.1. The blocking member 10 can be transferred through a blocking spring 13 from its blocking position 10.2 into its disengagement position 10.1.

An outside door grip for a door of a vehicle can comprise a handle for a door for opening and closing of the door, a swivel bearing axis 12 attached to the door, a blocking member 10 swiveling on the swivel bearing axis 12, said blocking member 10 having sufficient mass to be actuated to swivel around the swivel bearing axis by a crash 60 of the vehicle and wherein forces of inertia are generated in the blocking member during a crash 60 of the vehicle thereby causing the blocking member to swivel around the swivel bearing axis 12 from a disengaged position 10.1 to a blocking position 10.2 and wherein an actuation of the handle is blocked when the blocking member 10 is disposed in the blocking position 10.2, a detent spring 21 having a release position 21.2 and a locking position 21.1 and attached to the blocking member 10, wherein upon a crash of the vehicle the detent spring 21 is moved from the release position 21.2 of the locking spring 21 to the locking position 21.1 of the detent spring 21, and counter locking means 30 engaging with the detent spring 21 in the locking position 21.1.

There can be further furnished a release member 50 for engaging the detent spring 21, wherein the detent spring 21 is movable from the locking position 21.1 into the release position 21.2, an opposing member 11 formed at the blocking member 10 and engaged by the release member 50, wherein the blocking member 10 is movable from the blocking position 10.2 into a release position 10.3 of the blocking member 10 with the opposing member 11 engaged by the release member 50, and wherein the blocking member 10 is swivelable from the release position 10.3 of the blocking member 10 into the disengaged position 10.1 of the blocking member 10, and a snap-in locking device 23 which locks 21 the blocking member 10 in the blocking position 10.2 of the blocking member 10.

The locking means 22 can be in the form of a rod having a rectangular cross-section. The bar can extend from the blocking member 20 to the opposing member 11. The locking means 22 can have side compartments. One of the side compartments can engage and guide the counter locking means 30.

There is also provided a method for safeguarding an outside door grip on a vehicle including disposing a handle on a door for gripping and opening of the door, mounting a swivel bearing axis 12 on the door, disposing a blocking member 10 on the swivel bearing axis 12, said blocking member 10 having sufficient mass to be actuated by a crash 60, attaching a detent spring 21 having a release position 21.2 and a locking position 21.1 to the blocking member 10. The door can be subjected to a crash 60 of the vehicle and generate forces of inertia in the blocking member 10, thereby moving 14 the blocking member 10 from a disengaged position to a blocking position around the swivel bearing axis 12, thereby moving the detent spring 21 from the release position 21.2 of the detent spring 21 to the locking position 21.1 of the detent spring 21, thereby engaging counter locking means 30 with the detent spring 21 in the locking position 21.1, and thereby blocking an actuation of the handle with the blocking position 10.2 of the blocking member 10.

The detent spring 21 can engage with a release member 50. The detent spring 21 can move from the locking position 21.1 into the release position 21.2 and the blocking member 10 can move from the blocking position 10.2 into a release position 10.3 of the blocking member 10 with an opposing member 11 of the blocking member 10 engaged by the release member 50. The blocking member 10 can swivel from its release position 10.3 into its disengaged position 10.1.

It can be concluded overall that the devices presented here are only representations of the invention by way of examples. The invention is not limited to the samples. Above all, further modifications are possible.

LIST OF REFERENCE CHARACTERS

10 blocking member
10.1 disengagement position of blocking member 10
10.2 blocking position of blocking member 10
10.3 release position of blocking member 10
11 opposing member
12 bearing axis of blocking member 10
13 retaining blocking spring
14 direction of motion of blocking member 10
20 means
21 detent element, detent spring
21.1 locking position of detent spring 21
21.2 release position of detent spring 21
22 locking means
23 snap-in locking device
30 counter locking means
40 support
50 release member
51 rocker
52 direction of the release motion
60 direction of the crash

The invention claimed is:

1. An outside door grip for vehicles, having a manually actuated handle, which handle upon actuation operates a lock disposed in the door, and having a pivotable blocking member serving as a mass blockage, wherein the blocking member is in fact disposed generally in its ineffective disengagement position and wherein the blocking member renders the handle actuatable, wherein the blocking member passes in case of a crash into an effective blocking position and therewith blocks the handle, characterized in that a snap-in locking device is furnished, which takes care that the blocking member remains at least for such time in its blocking position in case of a crash until the oscillations caused by the crash and acting on the outside door grip and/or the handle have decayed so far that an actuation of the handle cannot any longer be performed by the oscillations, wherein the snap-in locking device locks the blocking member in its blocking position, and is released from the blocking position by a actuation of a release member operatively connected to the snap-in locking device.

2. The outside door grip according to claim 1 wherein a detent element is furnished at the blocking member, wherein the detent element exhibits locking means, wherein this locking means can be brought in locking connection with counter locking means for generating the snap-in locking device.

3. The outside door grip according to claim 2, wherein the detent element is formed as a detent spring.

4. The outside door grip according to claim 2, wherein the counter locking means is formed at a support.

5. The outside door grip according to claim 2, wherein the detent element can be released through a release member from the locking position and wherein the detent element can be transferred into its release position.

6. The outside door grip according to claim 5 wherein the release member releases the locking position through the oscillations caused by the crash of the door or, respectively, of the outside door grip.

7. The outside door grip according to claim 5, wherein a device component, preferably the release member is brought into a working connection with an opposing member at the blocking member during release of the locking position and wherein the blocking member is held for some time in a release position even though the detent element is already disposed in its release position.

8. The outside door grip according to claim 5, wherein the release member releases the locking position by way of a manual actuation of the handle.

9. The outside door grip according to claim 5, wherein the release member is disposed immediately at the handle.

10. The outside door grip according to claim 5, wherein the release member is disposed at an element, in particular at the rocker, coupled to the handle, which element moves together with an actuation of the handle.

11. The outside door grip according to claim 1, wherein the blocking member is transferred through a blocking spring from its blocking position into its disengagement position.

12. An outside door grip for a door of a vehicle comprising a handle for a door for opening and closing of the door;

a swivel bearing axis attached to the door; a blocking member swiveling on the swivel bearing axis, said blocking member having sufficient mass to be actuated to swivel around the swivel bearing axis by a crash of the vehicle and wherein forces of inertia are generated in the blocking member during a crash of the vehicle thereby causing the blocking member to swivel around the swivel beating axis from a disengaged position to a blocking position, and wherein an actuation of the handle is blocked when the blocking member is disposed in the blocking position;

a detent spring having a release position and a locking position and attached to the blocking member, wherein upon a crash of the vehicle the detent spring is moved from the release position of the detent spring to the locking position of the detent spring;

counter locking means engaging with the detent spring in the locking position; and a release member for engaging the detent spring to release the detent spring from the locking position into the release position.

13. The outside door grip according to claim 12 further comprising:

an opposing member formed at the blocking member and engaged by the release member, wherein the blocking member is movable from the blocking position into a release position with the opposing member engaged by the release member, and wherein the blocking member is swivelable from the release position of the blocking member into the disengaged position of the blocking member;

the detent spring comprising a snap-in locking device which locks the blocking member in the blocking position of the blocking member.

14. The outside door grip according to claim 12, wherein the detent element can be released through the release member from the locking position and wherein the detent element can be transferred into its release position.

15. A method for safeguarding an outside door grip on a vehicle comprising disposing a handle on a door allowing for opening of the door;

providing a swivel bearing axis on the door;

disposing a blocking member on the swivel bearing axis, said blocking member having sufficient mass to be actuated by a crash;

attaching a detent spring having a release position and a locking position to the blocking member;

subjecting the door to a crash of the vehicle;

generating forces of inertia in the blocking member;

moving the blocking member around the swivel axis from a disengaged position to a blocking position;

moving the detent spring from the release position to the locking position;

engaging counter locking means with the detent spring in the locking position;

blocking an actuation of the handle with the blocking position of the blocking member;

engaging the detent spring with a release member;

moving the detent spring from the locking position into the release position, releasing the blocking member from the blocking position.

* * * * *